US008602577B2

(12) United States Patent
Luo et al.

(10) Patent No.: US 8,602,577 B2
(45) Date of Patent: Dec. 10, 2013

(54) SIDE-EMITTING SOLID STATE LIGHT SOURCE MODULES WITH FUNNEL-SHAPED PHOSPHOR SURFACE

(75) Inventors: Hong Luo, Andover, MA (US); Miguel Galvez, Danvers, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 187 days.

(21) Appl. No.: 13/093,011

(22) Filed: Apr. 25, 2011

(65) Prior Publication Data

US 2012/0268915 A1 Oct. 25, 2012

(51) Int. Cl.
*F21V 9/16* (2006.01)

(52) U.S. Cl.
USPC ..... 362/84; 362/249.02; 362/294; 313/498

(58) Field of Classification Search
USPC ..... 313/110–117; 362/217.01–217.03, 362/249.01–249.03, 296.01, 311.02, 362/311.06, 341, 345, 543–549, 800
See application file for complete search history.

(56) References Cited

U.S. PATENT DOCUMENTS

| | | | | |
|---|---|---|---|---|
| 6,350,041 | B1 * | 2/2002 | Tarsa et al. | 362/231 |
| 7,192,163 | B2 * | 3/2007 | Park | 362/294 |
| 7,293,908 | B2 * | 11/2007 | Beeson et al. | 362/612 |
| 7,703,942 | B2 * | 4/2010 | Narendran et al. | 362/231 |
| 7,942,556 | B2 * | 5/2011 | Harbers et al. | 362/294 |
| 8,337,030 | B2 * | 12/2012 | Pickard | 362/84 |
| 2003/0002272 | A1 | 1/2003 | Suehiro et al. | |
| 2003/0185005 | A1 | 10/2003 | Sommers et al. | |
| 2006/0268555 | A1 * | 11/2006 | Kelly | 362/341 |
| 2007/0263379 | A1 | 11/2007 | Dowling | |
| 2010/0290226 | A1 * | 11/2010 | Harbers et al. | 362/235 |
| 2010/0327745 | A1 | 12/2010 | Dassanayake et al. | |
| 2011/0299281 | A1 * | 12/2011 | Vandersluis et al. | 362/249.02 |
| 2012/0014111 | A1 * | 1/2012 | Welten | 362/296.08 |
| 2012/0161626 | A1 * | 6/2012 | van de Ven et al. | 315/35 |

FOREIGN PATENT DOCUMENTS

| | | | | |
|---|---|---|---|---|
| DE | 10 2004 053116 | A1 | 5/2006 | |
| WO | 00/19546 | A1 | 4/2000 | |
| WO | 2005/107420 | A2 | 11/2005 | |
| WO | 2009/068262 | A1 | 6/2009 | |
| WO | 2010/079391 | A1 | 7/2010 | |
| WO | WO 2010110652 | A1 * | 9/2010 | F21K 99/00 |

OTHER PUBLICATIONS

Patrick Menn, International Search Report and Written Opinion of the International Searching Authority, May 25, 2012, pp. 1-11, European Patent Office, Rijswijk, The Netherlands.

* cited by examiner

*Primary Examiner* — Donald Raleigh
(74) *Attorney, Agent, or Firm* — Shaun P. Montana

(57) ABSTRACT

A lighting module has a base, a top, a longitudinal axis from the base's center to the top's center, and a lateral edge surrounding the axis. Solid state light sources at the base emit excitation light, having an excitation wavelength and an angular distribution centered about the axis, toward the top. A lens defines a lateral edge of the module, which extends from the base to the top and reflects the excitation light. A phosphor surface of the module, shaped as a funnel having a wide end proximate the top and a narrow end proximate the base, receives and absorbs the excitation light, producing phosphor light that exits the module through the lateral edge. The phosphor light's wavelength is greater than the excitation wavelength, and has an angular distribution at each point on the phosphor surface centered about a local surface normal with respect to the phosphor surface.

16 Claims, 13 Drawing Sheets

SIDE-EMITTING SOLID STATE LIGHT SOURCE MODULES WITH FUNNEL-SHAPED PHOSPHOR SURFACE

TECHNICAL FIELD

The present invention relates to geometry for producing generally lateral and downward-propagating white-light illumination, using solid state lighting sources and a phosphor located away from the solid state lighting source.

BACKGROUND

Solid state light sources, such as but not limited to light emitting diodes (LEDs), organic LEDs (OLEDs), and the like, have significant advantages over conventional incandescent light sources. These include lower power requirements and longer lifetime. Unlike typical incandescent light sources, which radiate light generally uniformly in all directions, a solid state light source has a light output that is generally directional. Such directionality may offer new-found flexibility in producing illumination systems that have tailored light output.

SUMMARY

Embodiments described herein produce white-light illumination in a generally lateral and downward-propagating direction. A module according to embodiments described herein has a longitudinal axis from a downward to an upward direction, and emits white phosphor light generally downward and laterally from the module. A light engine including least one LED chip is mounted on a top surface of a heat sink, emitting excitation light generally upward, typically with a blue wavelength. A conically-shaped lens extends from the heat sink to a top of the module, with the cone having a narrow end at the heat sink and a wide end at the top of the module. The lens reflects upward all or a part of any blue excitation light that strikes it. The upward-traveling blue light is received and absorbed by a funnel-shaped phosphor surface, where the funnel has a narrow end at the heat sink and a wide end at or near the top of the module. The phosphor surface emits phosphor light generally downward and laterally, at a wavelength longer than that of the excitation light. The phosphor light transmits through the lens and exits the module.

In an embodiment, there is provided a light-producing module having a base, a top, a longitudinal axis extending from a center of the base to a center of the top, and a lateral edge surrounding the longitudinal axis. The light-producing module includes: a plurality of solid state light sources disposed at the base of the module emitting excitation light toward the top of the module, the excitation light having at least one excitation wavelength and having an angular distribution centered about the longitudinal axis of the module; a lens defining the lateral edge of the module and extending from the base of the module to the top of the module, the lens reflecting the excitation light; and a phosphor surface receiving and absorbing the excitation light and producing phosphor light, the phosphor surface being shaped as a funnel having a wide end proximate the top of the module and a narrow end proximate the base of the module, the phosphor light having a wavelength greater than the at least one excitation wavelength and having an angular distribution at each point on the phosphor surface centered about a local surface normal with respect to the phosphor surface, the phosphor light exiting the module through the lateral edge defined by the lens.

In a related embodiment, the lens may enclose a gas-filled volume between the phosphor surface and the lateral edge of the module, and the excitation light and the phosphor light may propagate through the gas when inside the module. In a further related embodiment, the phosphor surface may be a funnel element, the funnel element having a narrow end proximate the base of the module and a wide end proximate the top of the module, the plurality of solid state light sources being arranged outside the narrow end of the funnel element, the wide end of the funnel element extending radially outward to the lens. In a further related embodiment, the base of the module may include a heat sink upon which the plurality of solid state light sources are mounted, and the heat sink may include a hole at its center, coaxial with the longitudinal axis of the module, that receives a narrow end of the funnel element. In another further related embodiment, the lens may be shaped as a cone having a narrow end at the base of the module and a wide end at the top of the module.

In another related embodiment, the lens may fill essentially all the volume between the phosphor surface and the lateral edge of the module, and the excitation light and the phosphor light may propagate through the lens material when inside the module, and the excitation light may reflect off the lateral edge of the module through total internal reflection. In a further related embodiment, the phosphor surface may be an inner surface of the lens. In a further related embodiment, the base of the module may include a heat sink upon which the plurality of solid state light sources is mounted.

In yet another related embodiment, the phosphor surface may receive a portion of the excitation light directly from the plurality of solid state light sources and may receive the remainder of the excitation light from the reflection from the lens. In still another related embodiment, the top of the module may be opaque and may include a reflector to reflect unabsorbed excitation light back toward the phosphor surface.

In yet still another related embodiment, each solid state light source in the plurality of solid state light sources may include a hemispherical lens directly above a respective chip. In still yet another embodiment, the phosphor surface and the lens may be rotationally symmetric about the longitudinal axis of the module. In yet another related embodiment, at least one excitation wavelength may be between 380 nm and 500 nm.

In another embodiment, there is provided a light-producing module. The light-producing module includes: a plurality of solid state light sources arranged in a generally horizontal plane, the plurality of solid state light sources emitting blue light generally upwards with an angular distribution centered around a vertical longitudinal axis of the module; a funnel-shaped phosphor surface having a phosphor for absorbing the blue light and emitting phosphor light having a longer wavelength than the emitted blue light, the funnel-shaped phosphor surface having a generally cylindrical portion centered on the longitudinal axis of the module and extending upward from a central portion of the plurality of solid state light sources, the funnel-shaped phosphor surface flaring radially outward from the longitudinal axis above the generally cylindrical portion; and a generally conical element laterally surrounding the plurality of solid state light sources and extending from the generally horizontal plane of the plurality of solid state light sources to a peripheral edge of the funnel-shaped phosphor surface, the conical element reflecting the blue light upwards from the plurality of solid state light sources to the funnel-shaped phosphor surface, the conical element transmitting the phosphor light from the funnel-shaped phosphor surface.

In a related embodiment, at the generally horizontal plane of the plurality of solid state light sources, the plurality of solid state light sources may be radially disposed between an outer edge of the generally cylindrical portion of the funnel-shaped phosphor surface and an inner edge of the generally conical element. In another related embodiment, the funnel-shaped phosphor surface may asymptotically approach horizontal with increasing radial distance away from the longitudinal axis and with increasing longitudinal distance away from the plurality of solid state light sources. In still another related embodiment, a radial cross-section of the funnel-shaped phosphor surface may have non-convex concavity throughout. In yet another related embodiment, a radial cross-section of the generally conical element may be generally flat. In still yet another related embodiment, the funnel-shaped phosphor surface may emit phosphor light having an angular distribution centered about a local surface normal.

In another embodiment, there is provided a method of producing generally lateral and downward-propagating illumination. The method includes: emitting blue light generally upward, the blue light having an angular distribution centered about a vertical axis; surrounding the vertical axis with a cone-shaped lens that reflects upward any blue light that strikes the outside of the cone, the cone widening in the upward direction; receiving and absorbing the blue light at a funnel-shaped phosphor surface, the funnel widening in the upward direction; emitting phosphor light from the funnel-shaped phosphor surface, the phosphor light being emitted generally laterally and downward; and transmitting the phosphor light through the outside of the cone-shaped lens.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

As used herein, the terms "up", "down", "vertical", "lateral", "horizontal" and the like are for convenience. Such terms are useful when describing a particular light output, and are intended to describe the orientations of particular features on a light module when used as intended. For instance, for an overhead light in an outdoor parking lot, the light module may be mounted above the observer, and may desirably have an output pattern that directs most or all of its light downward and laterally, toward the pavement, with little or none directed upward, toward the sky. For this example, it is instructive to describe the orientations of particular features on the module with respect to their orientations during typical use. A "top" of the module may face upward during use, a "bottom" or "base" may face downward during use. It is understood that such labels do not imply that a particular side of the module inherently and always faces upward or downward, only that during typical use, a so-called "top" side faces upward, a "bottom" side faces downward, and so forth. In actual use, a module may be placed in any desired orientation.

Figure 1:
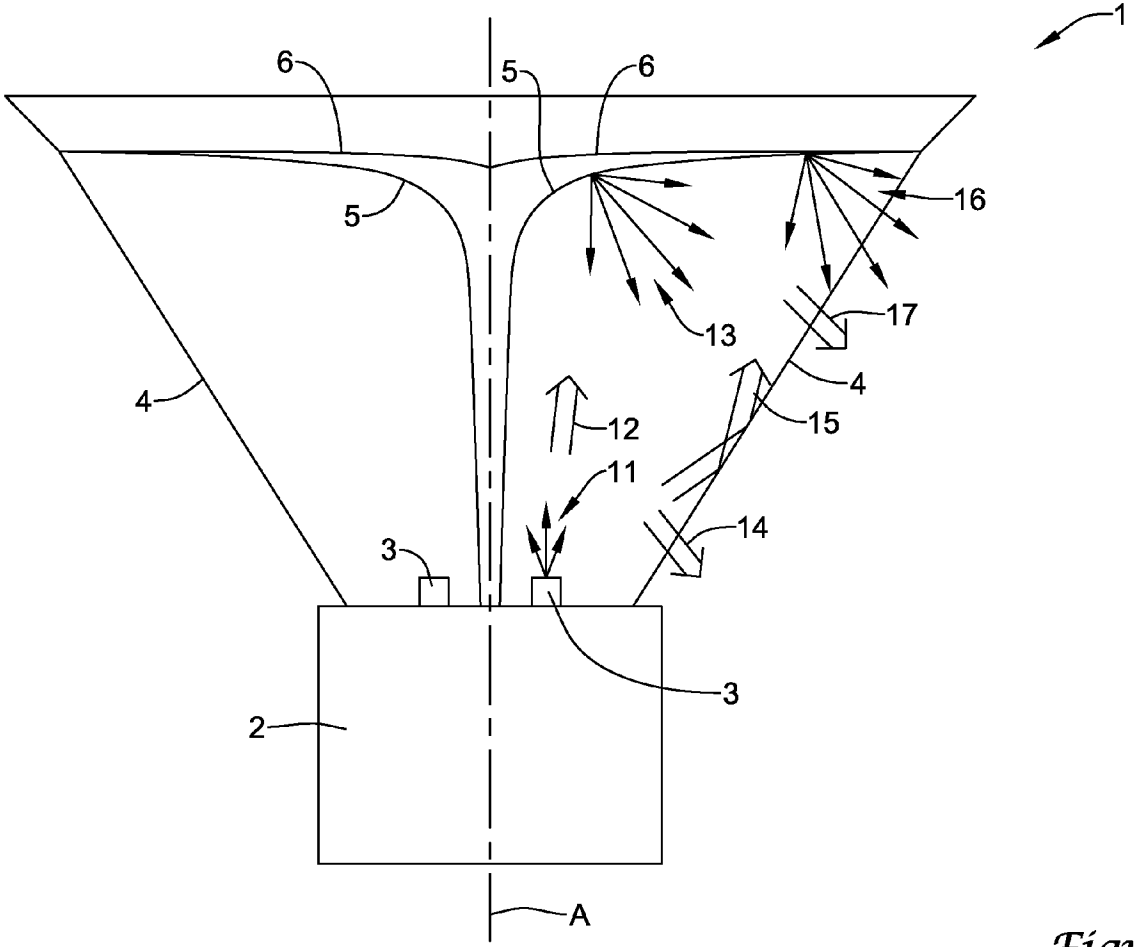
FIG. 1 is a cross-sectional drawing of a light-producing module according to embodiments described herein.

FIG. 1 is a cross-sectional drawing of an example light-producing module 1. The module 1 has a vertically-oriented longitudinal axis A. Some or all of the elements and features of the module 1 may be rotationally symmetric about the longitudinal axis A. The module 1 has a base 2, which may typically serve as the mechanical anchor for the module 1. The base 2 may be gripped during installation and removal, and may optionally include handles, ridges, or other mechanical aids to improve gripping by a user. If the module 1 is to be used in a threaded socket, then the base 2 may include threads at its bottom. Alternatively, the module 1 may be placed onto a mated electrical connector, and may include appropriate connections along the bottommost surface or elsewhere on the base 2. In some cases, the base 2 functions as a thermal management system (i.e., a heat sink or any other equivalent system, device, and/or material capable of dissipating heat).

The module 1 includes a plurality of solid state light sources, such as but not limited to light emitting diodes (LEDs) 3, typically mounted on or near a top surface of the base 2. The LEDs 3 may be arranged in a suitable pattern, such as but not limited to rectangular, square, or rotationally symmetric around the longitudinal axis A of the module 1. The LEDs 3 may be arranged in a single plane, in multiple planes, or at different locations along the longitudinal axis. The LEDs 3 may lie generally perpendicular to the longitudinal axis A, so that their surface normals are parallel to the longitudinal axis A. In general, LEDs 3 have a directional output, so that the most light is emitted from the LEDs 3 perpendicular to the face of the LEDs 3. At angles farther away from the surface normal, the light output decreases, so that parallel to the LEDs 3, the light output is essentially zero. In many cases, the angular light output of the bare LEDs 3 may follow a Lambertian distribution. In some cases, the LEDs 3 may have a collimating lens placed above them, which may narrow the angular spread of the light therefrom. Each LED 3 may have its own collimating lens, or there may be one collimating lens for several LEDs 3. In some cases, the collimating lenses are hemispherical or are portions of a sphere.

The LEDs 3 may all have the same output wavelength, or may optionally use different wavelengths for at least two of the LEDs 3. In some embodiments, at least one of the LEDs 3 may have a wavelength in the blue portion of the visible light spectrum, in the range of 450 nm to 475 nm, or in the violet portion of the visible light spectrum, in the range of 380 nm to 450 nm. Emitted wavelengths shorter than 380 nm may also be used, but such short wavelengths are considered to be in the ultraviolet portion of the spectrum, where transmission through common glass may be difficult or impossible. For the purposes of this document, the term "blue" may be used to refer to the wavelength ranges of 450-475 nm, 450-500 nm, 400-475 nm, 400-500 nm, 400-475 nm, 380-475 nm, 380-500 nm, less than 450 nm, less than 475 nm, and/or less than 500 nm.

In general, the spectral output of a light emitting diode has a distribution, usually described by center wavelength and a bandwidth. The bandwidth is often given as a full-width-at-half-maximum (FWHM) of output power. Typical FWHM bandwidths for common LEDs are in the ranges of 15-40 nm, 15-35 nm, 15-30 nm, 15-25 nm, 15-20 nm, 20-40 nm, 20-35 nm, 20-30 nm, 20-25 nm, 25-40 nm, 25-35 nm, 25-30 nm, and/or 24-27 nm.

In typical use, the blue LEDs 3 produce light in the blue portion of the spectrum, referred to in this document as "excitation light" 11. The excitation light 11 is directed onto a phosphor that absorbs the excitation light 11, in the blue portion of the spectrum, and emits light with a longer wavelength, which is referred to in this document as "phosphor light" 13 and 16. The spectral properties of the phosphor light are strongly dependent on the particular phosphor used, but common phosphors emit light with a relatively large bandwidth over the remainder of the visible spectrum, typically from 475-750 nm. In many cases, the phosphor composition may be adjusted so that the phosphor light 13 and 16, optionally combined with the excitation light 11, produces illumination that is aesthetically pleasing to human eyesight.

The module 1 may include a lens 4 that surrounds the longitudinal axis A of the module 1 and defines a lateral edge of the module 1. Such a lens 4 encloses the module 1 for protection, and transmits the output light out of the module 1. In the specific example of FIG. 1, the lens 4 is generally conical or cone-shaped, with a narrow end at or near the base 2 of the module 1 and a wide end at or near the top of the module 1. More specific designs for the lens 4 are shown in FIGS. 2-4 and 10-13. Additionally, in some embodiments, the lens 4 also redirects any excitation light 11 that strikes it by reflecting it upward toward the phosphor. The reflection may be from a bare interface between air and the glass or plastic of the lens 4, or may be enhanced with one or more thin film coatings on the surface of the lens 4. As such, the phosphor may receive excitation light 11 directly from the LEDs 3, as well as excitation light 15 reflected from the lens 4.

In some embodiments, it is the high angle of incidence of the excitation light 15 is what leads to high reflectivity, rather than any wavelength-dependent properties. In general, a bare air/glass or air/plastic interface shows fairly high power reflectivity at high angles of incidence, with little dependence on wavelength. For incidence from air, incident angles higher than the Brewster's angle tend to show this fairly high reflectivity. For incidence from air, the Brewster's angle is ($\tan^{-1} n$), where n is the refractive index of the glass or plastic. For incidence from glass or plastic, incident angles higher than the Brewster's angle ($\tan^{-1}$ [l/n]) show this fairly high reflectivity, but angles higher than the critical angle ($\sin^{-1}$ [l/n]) show 100% or nearly 100% power reflectivity due to total internal reflection at the interface. Note that the module 1 may be filled with any suitable gas, such as air or nitrogen, or argon; the critical and Brewster's angles do not change significantly. The module may be sealed, or may have one or more vents. As such, the lens 4 tends to reflect the excitation light 15 at relatively high angles of incidence, while transmitting the phosphor light 14, 17 at relatively low angles of incidence.

The phosphor itself may be disposed on a phosphor surface 5. The phosphor surface 5 may be shaped like a funnel, with a wide end at or near the top of the module 1 and a narrow end at or near the base 2 of the module 1. In some embodiments, the phosphor surface 5 may be on the "outside" or "underside" of the funnel shape. In other embodiments, the funnel shape may be solid or a hollow shell with phosphor particles embedded in the funnel shape. For such embodiments, the phosphor may be embedded in a generally transparent plastic or ceramic material, and then molded to the desired funnel shape. For the purposes of this application, the term "phosphor surface" is intended to mean not only phosphor particles on an external or internal surface, but phosphor particles distributed within a volume. In general, the volume may be relatively thin, such as a shell that forms the funnel surface, or may be relatively thick, such as a solid element with a funnel-shaped downward-facing surface.

The LEDs 3 may be outside the radius of the narrow end of the funnel. The lens 4 may extend from the base 2, where the LEDs 3 may be inside the radius of the narrow end of the lens 4, toward the top of the module 1, where the lens 4 may approach or meet the wide end of the funnel-shaped phosphor surface 5. The phosphor surface 5 may receive and absorb excitation light 12 directly from the LEDs 3, then emit phosphor light 13 that exits 14 the module 1 through the lens 4. Similarly, the phosphor surface 5 may receive and absorb excitation light 15 that reflects off the lens 4, then emit phosphor light 16 that exits 17 the module 1 through the lens 4.

In all such embodiments, the angular profile of the emitted phosphor light is centered about a local surface normal of the phosphor surface 5, the location on the phosphor surface 5 corresponding to the location at which the excitation light is absorbed. For the specific design of FIG. 1, the phosphor light emitted from location 13 is oriented more laterally than the phosphor light emitted from location 16, which in comparison is more vertical and downward. The specific shape profiles of the phosphor surface 5 and the lens 4 are chosen to achieve a desired spatial angular profile of the exiting light 14 and 17 through the lens 4. Such shapes are most easily handled during computer raytrace simulations of the optical performance of the module 1, during the design phase of the module 1 and well before the parts are manufactured.

More specific options for the phosphor surface 5 are shown in FIGS. 2-4 and 6-9.

In some embodiments, not all of the excitation light 11, 12, 15 is absorbed by the phosphor surface 5, so a reflector 6 is located above the phosphor surface 5 to reflect any transmitted excitation light 11, 12, 15 back downward toward the phosphor surface 5 for potential absorption. The shape of the reflector 6 may be used to further tailor the output profile of the module 1. In the specific embodiment shown in FIG. 1, the reflector 6 is dimpled, extending farthest downward along the longitudinal axis A of the module. In other embodiments, different shapes may be used, including flat, curved, or dimpled upward. In some embodiments, the top of the module 1 may be generally opaque, so that no light exits the module through the top.

Note that in FIG. 1, the optical surfaces are shown, rather than the structures that mechanically support them. For instance, the lens 4 is shown as a single surface that reflects excitation light 15 and transmits phosphor light 14, 17. Such a surface has mechanical support by a real, physical element. Some examples of such physical elements are shown in FIGS. 2-4.

Figure 2:
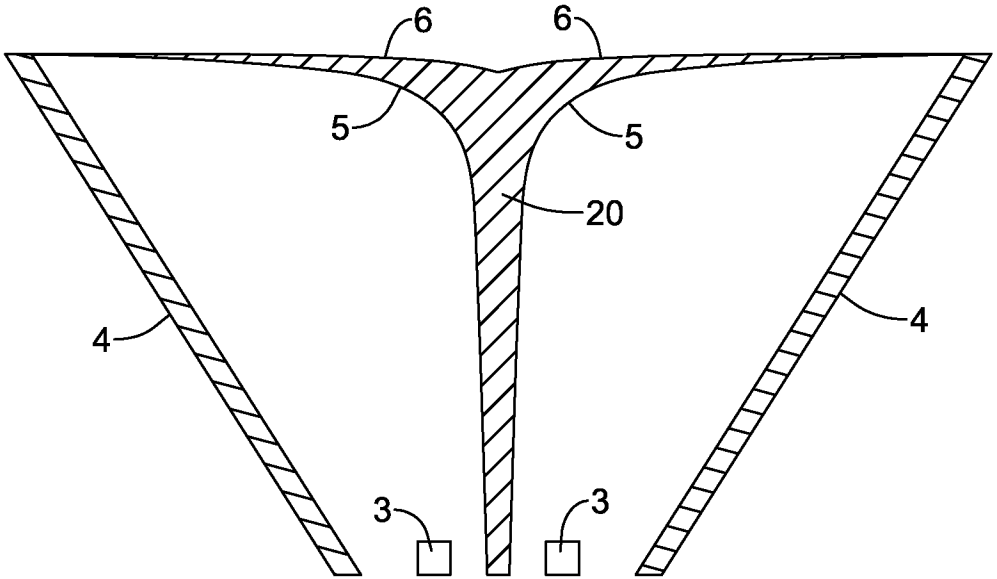
FIG. 2 is a cross-sectional drawing of a solid element having a funnel-shaped phosphor surface and a cone-shaped lens according to embodiments described herein.

FIG. 2 is a cross-sectional drawing of a solid element 20 having a funnel-shaped phosphor surface 5 on its "underside" and a reflector 6 on its "top" side. This may be referred to as a funnel element 20. Such a solid funnel element 20 may be molded from any suitable transparent and/or substantially transparent plastic. In general, the transparency of the solid funnel element may be secondary, and translucency may be sufficient, because most or all of the light inside the solid funnel 20 may be excitation light that failed to be absorbed in its initial pass through the phosphor layer. The lens 4 in this example may be a relatively thin sheet, shaped like a cone, much like the lateral surface of a common pint-sized drinking glass.

Figure 3:
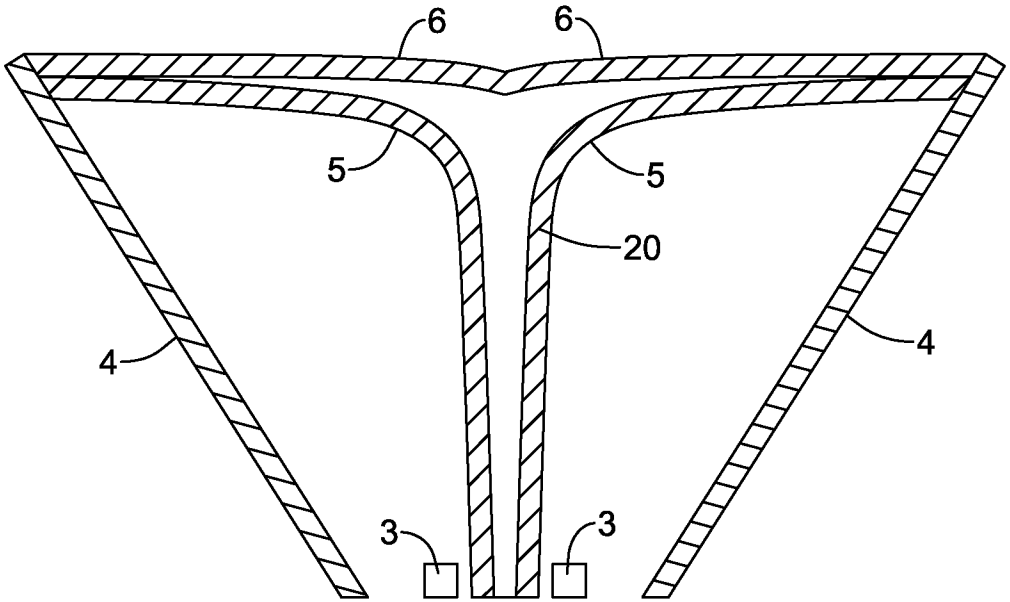
FIG. 3 is a cross-sectional drawing of a hollow element having a funnel-shaped phosphor surface and a cone-shaped lens according to embodiments described herein.
Figure 4:
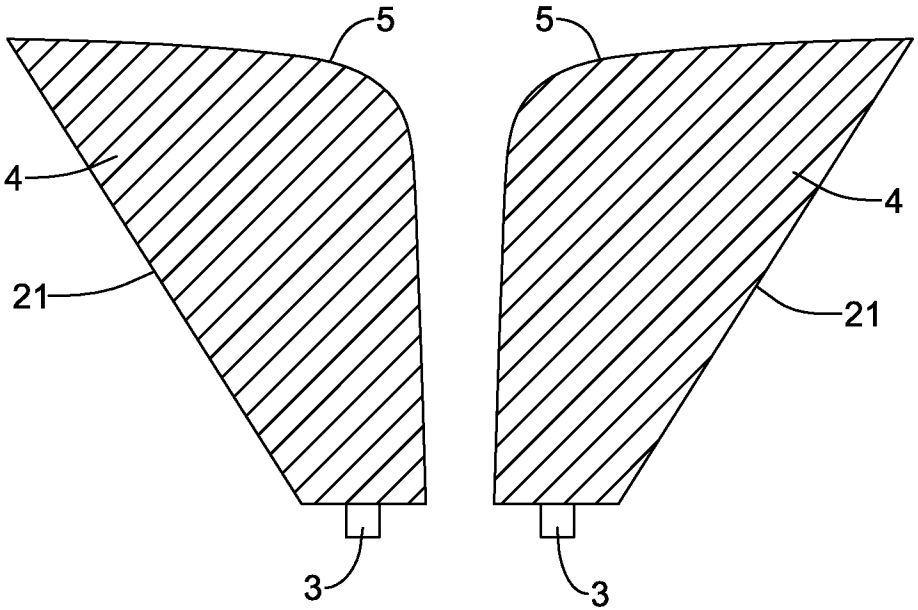
FIG. 4 is a cross-sectional drawing of a solid lens having a funnel-shaped inner phosphor surface and having a cone-shaped outer surface according to embodiments described herein.

FIG. 3 is a cross-sectional drawing of a hollow element 20 having a funnel-shaped phosphor surface 5 on its "underside" and a reflector 6 on its "top" side. In some cases, a hollow funnel may be more difficult to mold than a solid funnel, but optically, it should function largely the same as the solid funnel of FIG. 2, with a phosphor deposited on its "underside" surface.

In FIGS. 2 and 3, the funnel-shaped phosphor surface 5 is on a separate element from the lens 4. In other embodiments, the lens 4 may be made to additionally include the phosphor surface as well.

FIG. 4 is a cross-sectional drawing of a solid lens 4 having a funnel-shaped inner phosphor surface 5 and having a cone-shaped outer surface 21. Such a solid lens 4 may be molded from a suitable plastic material. Both the phosphor surface 5 and the outer surface 21 of the solid lens 4 may assume any suitable shape, including those shown by example in FIGS. 6-13. A module that uses such a solid lens 4 may additionally include a reflector (not shown) near the top of the module, which reflects any excitation light that passes through the phosphor surface 5 back to the phosphor surface 5.

Figure 5:
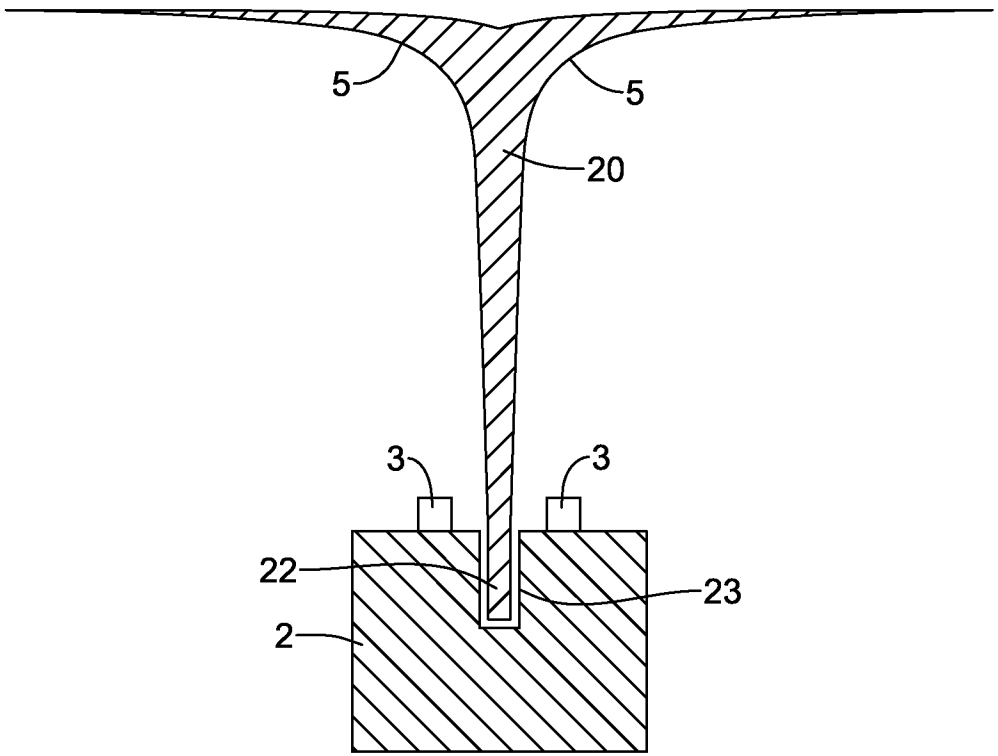
FIG. 5 is a cross-sectional drawing of a funnel element, with the narrow end of the solid funnel element inserted into a hole in the heat sink according to embodiments described herein.

FIG. 5 shows an example of how a funnel element 20 may be attached to the base 2. In the example of FIG. 5, the narrow end 22 of the funnel element 20 may be inserted into a hole 23 in the base 2. Note that the hole 23 may be at the center of the distribution of LEDs 3. The same attachment may be used for a hollow funnel element. Alternatively, the hole and the narrow end of the funnel element may be provided with mating threads, so that the funnel element may be screwed into the base.

Note that the shapes of the phosphor surface 5 and the lens 4 in FIGS. 1-5 are merely examples. In practice, the shapes of both of these elements may be adjusted, as well as the shape of the reflector 6, to give a desired output illumination. Typically, a designer may begin with a power requirement, such as a total number of watts in a particular wavelength region. The efficiency and other properties of the phosphor, combined with the power requirement, may determine properties of the light emitting diodes, such as their number and their locations. A designer may perform raytracing calculations to adjust the source locations and properties, the shape of the phosphor surface 5, and the shape of the lens 4, so that the module output satisfies the particular design requirements, which may include output power versus propagation angle and other suitable attributes. As a result, the surface shapes may vary from the examples of FIGS. 1-5. Such surface variations are shown in the additional examples of FIGS. 6-13.

Figure 6:
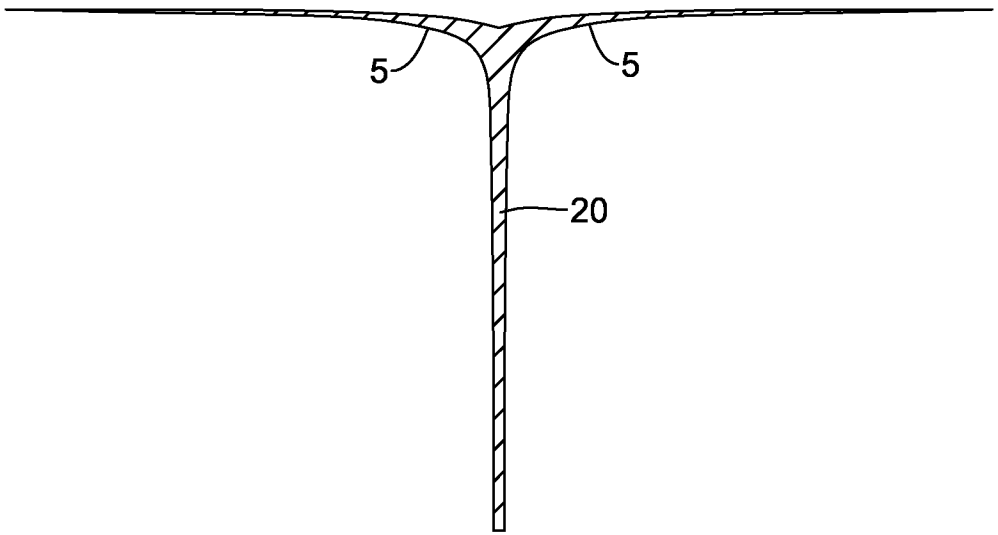
FIG. 6 is a cross-sectional drawing of a relatively thin funnel element according to embodiments described herein.

FIG. 6 is a cross-sectional drawing of a relatively thin funnel element 20. Here, the narrow portion of the funnel element 20 remains narrow for a significant portion of the funnel, possibly up to half the height of the funnel or more. The wide end of the funnel element 20 flares out relatively abruptly, so that the transition between narrow and wide may be relatively distinct. In some embodiments, the narrow end of the funnel element may be cylindrical, with no divergence below a particular height of the funnel, such as 5%, 10%, 15%, 20%, 25%, 30%, 35%, 40%, 45%, 50%, or more than 50% of the height of the funnel.

Figure 7:
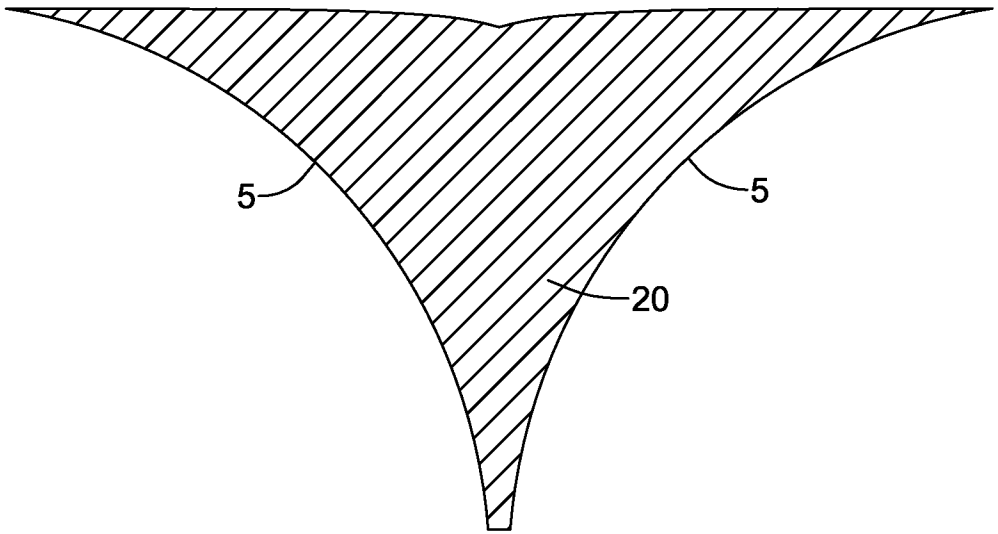
FIG. 7 is a cross-sectional drawing of a relatively wide funnel element according to embodiments described herein.

In contrast with FIG. 6, FIG. 7 is a cross-sectional drawing of a relatively wide funnel element 20. The phosphor surface 5 may be curved fairly gently, as opposed to the sharp transition between narrow and wide in FIG. 6. In FIG. 7, the cross-section of the phosphor surface 5 may be concave at each point on the phosphor surface 5. In the design of FIG. 6, the cross-section of the phosphor surface 5 may also include optional flat points, such as the points closest to the top and bottom of the funnel element 20.

Figure 8:
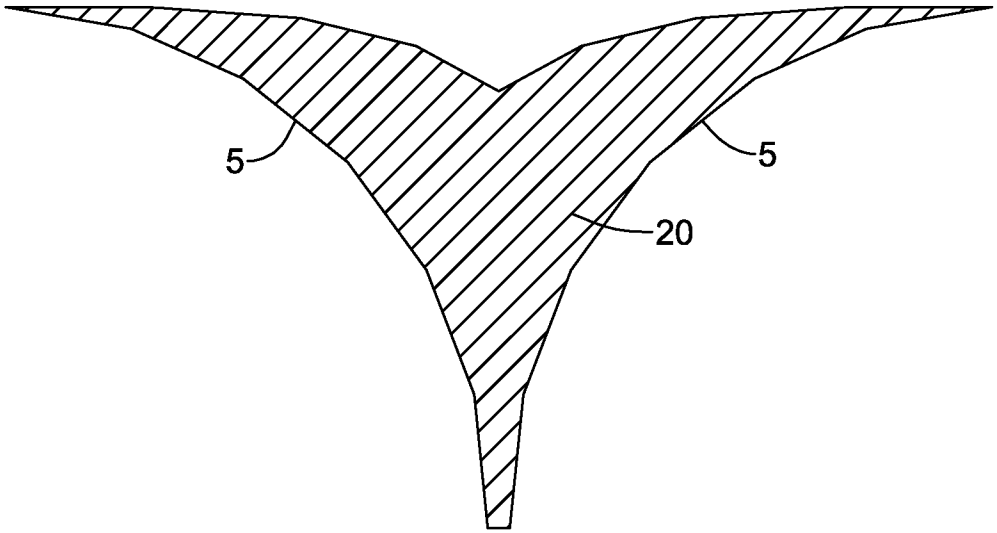
FIG. 8 is a cross-sectional drawing of a funnel element having corners according to embodiments described herein.

FIG. 8 is a cross-sectional drawing of a funnel element 20 having one or more corners on the cross-section of the phosphor surface 5.

Figure 9:
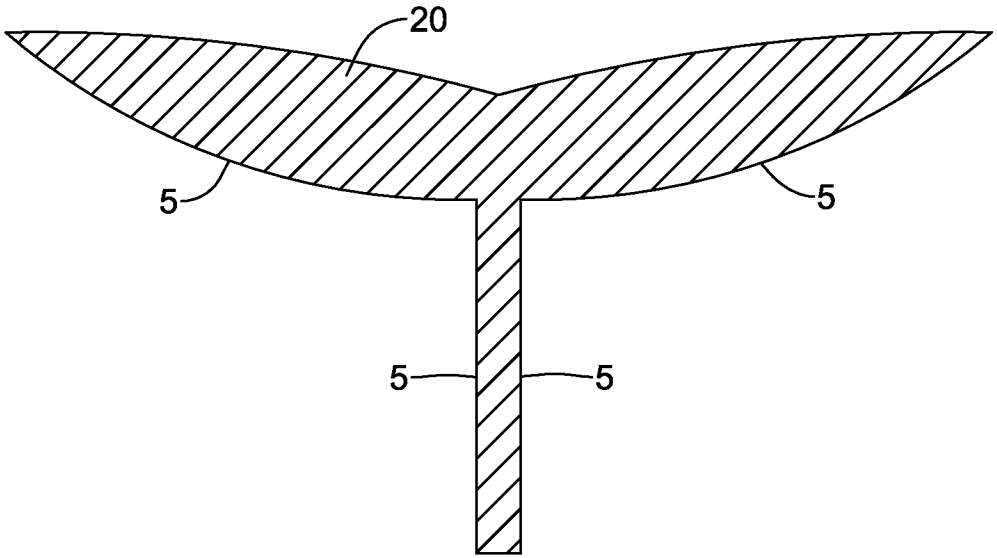
FIG. 9 is a cross-sectional drawing of a funnel element having upward concavity according to embodiments described herein.

FIG. 9 is a cross-sectional drawing of a funnel element 20 having upward concavity, where the upper portion of the phosphor surface 5 may be considered convex. In some embodiments, the convexity and concavity of the phosphor surface 5 may be varied from location to location on the phosphor surface 5.

In some embodiments, such as shown in FIGS. 6-9, the radial extent of the phosphor surface 5 increases or remains constant (i.e., does not decrease) from the bottom to the top of the phosphor surface 5.

As with the shape of the phosphor surface 5, the shape of the lens 4 (or, in the case of a solid lens, like in FIG. 4, the outer surface of the lens) may also be varied to achieve a particular output from the module. Some examples are shown in FIGS. 10-13.

Figure 10:
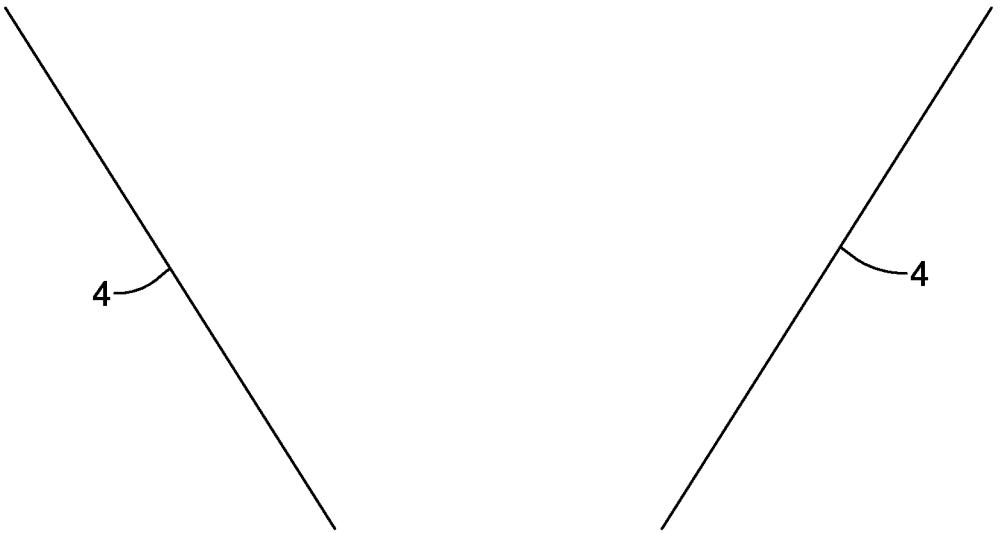
FIG. 10 is a cross-sectional drawing of a cone-shaped lens having a generally straight cross-section according to embodiments described herein.
Figure 11:
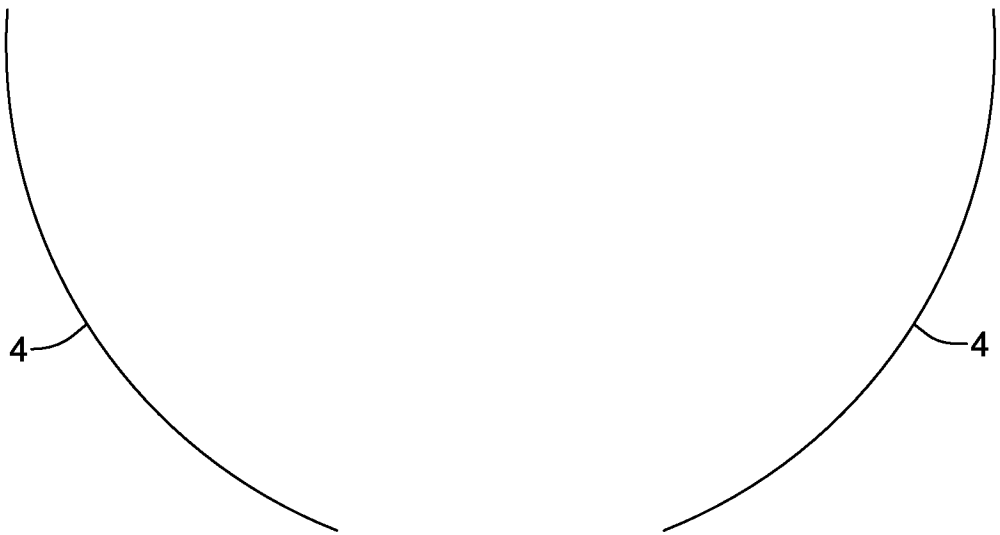
FIG. 11 is a cross-sectional drawing of a cone-shaped lens having a concave-up cross-section according to embodiments described herein.
Figure 12:
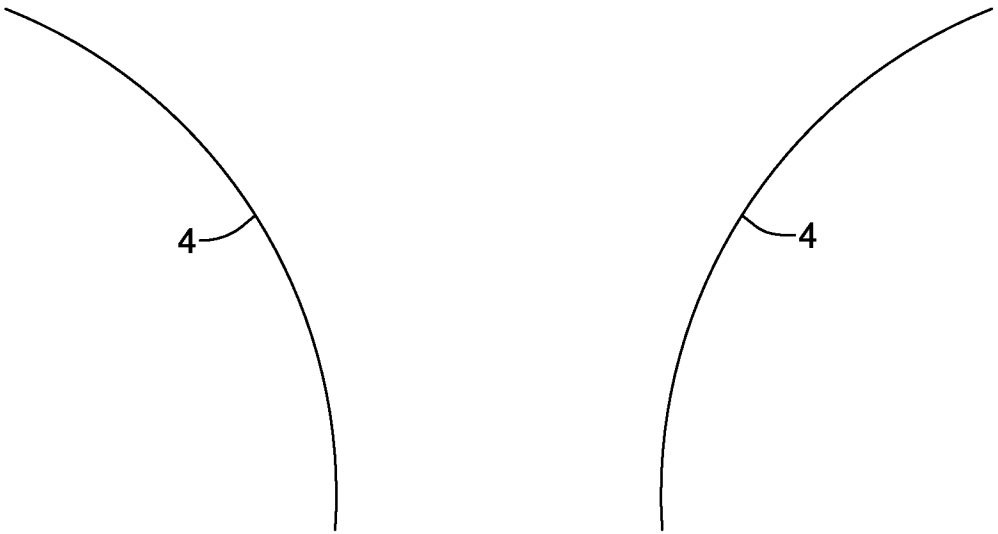
FIG. 12 is a cross-sectional drawing of a cone-shaped lens having a concave-down cross-section according to embodiments described herein.
Figure 13:
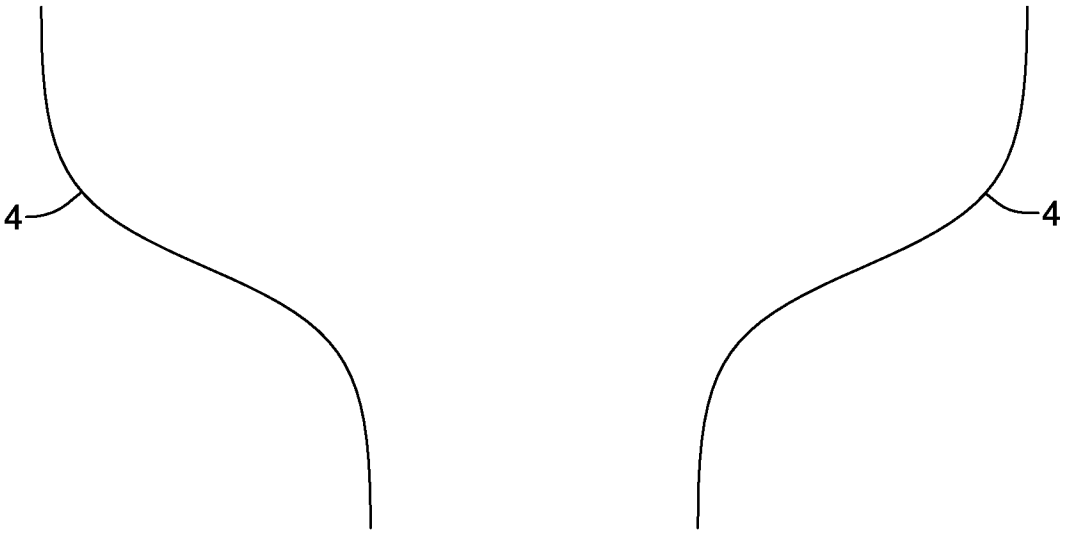
FIG. 13 is a cross-sectional drawing of a cone-shaped lens having a curved cross-section with mixed concavities according to embodiments described herein.

FIG. 10 is a cross-sectional drawing of a cone-shaped lens 4 having a generally straight cross-section. FIG. 11 is a cross-sectional drawing of a cone-shaped lens having a concave-up, (or convex) cross-section. FIG. 12 is a cross-sectional drawing of a cone-shaped lens having a concave-down (or concave) cross-section. FIG. 13 is a cross-sectional drawing of a cone-shaped lens having a curved cross-section with mixed concavities. As with the shape of the phosphor surface 5, a designer may adjust the shape of the lens 4 during the simulation process, in order to achieve a desired output from the module.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A light-producing module having a base, a top, a longitudinal axis extending from a center of the base to a center of the top, and a lateral edge surrounding the longitudinal axis, comprising:

a plurality of solid state light sources disposed at the base of the module emitting excitation light toward the top of the module, the excitation light having at least one excitation wavelength and having an angular distribution centered about the longitudinal axis of the module;

a lens defining the lateral edge of the module and extending from the base of the module to the top of the module, the lens reflecting the excitation light; and a phosphor surface receiving and absorbing the excitation light and producing phosphor light, the phosphor surface being shaped as a funnel having a wide end proximate the top of the module and a narrow end proximate the base of the module, the phosphor light having a wavelength greater than the at least one excitation wavelength and having an angular distribution at each point on the phosphor surface centered about a local surface normal with respect to the phosphor surface, the phosphor light exiting the module through the lateral edge defined by the lens, wherein the lens encloses a gas-filled volume between the phosphor surface and the lateral edge of the module, wherein the excitation light and the phosphor light propagate through the gas when inside the module, wherein the phosphor surface is a funnel element, the funnel element having a narrow end proximate the base of the module and a wide end proximate the top of the module, the plurality of solid state light sources being arranged outside the narrow end of the funnel element, the wide end of the funnel element extending radially outward to the lens, and wherein the base of the module includes a heat sink upon which the plurality of solid state light sources are mounted, and wherein the heat sink includes a hole at its center, coaxial with the longitudinal axis of the module, that receives a narrow end of the funnel element.

2. The light-producing module of claim 1, wherein the lens is shaped as a cone having a narrow end at the base of the module and a wide end at the top of the module.

3. The light-producing module of claim 1, wherein the lens fills essentially all the volume between the phosphor surface and the lateral edge of the module, and wherein the excitation light and the phosphor light propagate through the lens material when inside the module, and wherein the excitation light reflects off the lateral edge of the module through total internal reflection.

4. The light-producing module of claim 3, wherein the phosphor surface is an inner surface of the lens.

5. The light-producing module of claim 4, wherein the base of the module includes a heat sink upon which the plurality of solid state light sources is mounted.

6. The light-producing module of claim 1, wherein the phosphor surface receives a portion of the excitation light directly from the plurality of solid state light sources and receives the remainder of the excitation light from the reflection from the lens.

7. The light-producing module of claim 1, wherein the top of the module is opaque and includes a reflector to reflect unabsorbed excitation light back toward the phosphor surface.

8. The light-producing module of claim 1, wherein each solid state light source in the plurality of solid state light sources includes a hemispherical lens directly above a respective chip.

9. The light-producing module of claim 1, wherein the phosphor surface and the lens are rotationally symmetric about the longitudinal axis of the module.

10. The light-producing module of claim 1, wherein at least one excitation wavelength is between 380 nm and 500 nm.

11. A light-producing module, comprising:

a plurality of solid state light sources arranged in a generally horizontal plane, the plurality of solid state light sources emitting blue light generally upwards with an angular distribution centered around a vertical longitudinal axis of the module;

a funnel-shaped phosphor surface having a phosphor for absorbing the blue light and emitting phosphor light having a longer wavelength than the emitted blue light, the funnel-shaped phosphor surface having a generally cylindrical portion centered on the longitudinal axis of the module and extending upward from a central portion of the plurality of solid state light sources, the funnel-shaped phosphor surface flaring radially outward from the longitudinal axis above the generally cylindrical portion; and a generally conical element laterally surrounding the plurality of solid state light sources and extending from the generally horizontal plane of the plurality of solid state light sources to a peripheral edge of the funnel-shaped phosphor surface, the conical element reflecting the blue light upwards from the plurality of solid state light sources to the funnel-shaped phosphor surface, the conical element transmitting the phosphor light from the funnel-shaped phosphor surface;

wherein the light-producing module includes a lens and a base, wherein the lens encloses a gas-filled volume between the phosphor surface and a lateral edge of the module, wherein the blue light and the phosphor light propagate through the gas when inside the module, wherein the radially flaring portion of the funnel shaped phosphor surface extends radially outward to the lens, and wherein the base of the module includes a heat sink upon which the plurality of solid state light sources are mounted, and wherein the heat sink includes a hole at its center, coaxial with the longitudinal axis of the module, that receives an end of the funnel shaped phosphor surface that is opposite the radially flaring portion.

12. The light-producing module of claim 11, wherein at the generally horizontal plane of the plurality of solid state light sources, the plurality of solid state light sources are radially disposed between an outer edge of the generally cylindrical portion of the funnel-shaped phosphor surface and an inner edge of the generally conical element.

13. The light-producing module of claim 11, wherein the funnel-shaped phosphor surface asymptotically approaches horizontal with increasing radial distance away from the longitudinal axis and with increasing longitudinal distance away from the plurality of solid state light sources.

14. The light-producing module of claim 11, wherein a radial cross-section of the funnel-shaped phosphor surface has non-convex concavity throughout.

15. The light-producing module of claim 11, wherein a radial cross-section of the generally conical element is generally flat.

16. The light-producing module of claim 11, wherein the funnel-shaped phosphor surface emits phosphor light having an angular distribution centered about a local surface normal.

* * * * *